US007740129B2

(12) United States Patent
Herd

(10) Patent No.: US 7,740,129 B2
(45) Date of Patent: Jun. 22, 2010

(54) APPARATUS FOR CONVEYING SHEET-TYPE FLAT ITEMS

(75) Inventor: Nicolas Herd, Nürtingen (DE)

(73) Assignee: Kugler-Womako GmbH, Nuertingen (DE)

( * ) Notice: Subject to any disclaimer, the term of this patent is extended or adjusted under 35 U.S.C. 154(b) by 323 days.

(21) Appl. No.: 11/785,666

(22) Filed: Apr. 19, 2007

(65) Prior Publication Data

US 2007/0246329 A1 Oct. 25, 2007

(30) Foreign Application Priority Data

Apr. 20, 2006 (DE) ..... 10 2006 018 768

(51) Int. Cl.
*B65G 15/00* (2006.01)

(52) U.S. Cl. ..... 198/626.1; 198/626.3; 271/198

(58) Field of Classification Search ... 198/626.1–626.5, 198/861.1, 592, 620, 861.5, 586, 462.1; 271/271–274, 271/264, 3.2, 3.01, 3.02, 198
See application file for complete search history.

(56) References Cited

U.S. PATENT DOCUMENTS 3,166,311 A * 1/1965 Rabinow et al. ..... 271/12
3,815,482 A * 6/1974 Nelson ..... 493/53
4,285,513 A * 8/1981 Kwasnitza ..... 271/270
4,364,552 A * 12/1982 Besemann ..... 271/182
4,436,297 A * 3/1984 Chandhoke ..... 271/3.05
5,094,443 A * 3/1992 Young, Jr. ..... 271/245
5,106,077 A * 4/1992 Kawaguchi et al. ..... 271/302
5,330,316 A * 7/1994 Buckman et al. ..... 414/790.2
5,333,848 A * 8/1994 Rubscha ..... 271/3.14
5,433,431 A * 7/1995 Lowell ..... 271/273
6,082,733 A * 7/2000 Borel ..... 271/303
6,719,123 B2 * 4/2004 Jackson et al. ..... 198/626.1
6,742,778 B2 * 6/2004 Ferus ..... 271/3.01
7,478,721 B2 * 1/2009 Herd ..... 198/626.5

FOREIGN PATENT DOCUMENTS

DE 25 39 399 A1 4/1976
DE 29 20 667 A1 12/1980
DE 34 48 456 C2 11/1984

(Continued)

OTHER PUBLICATIONS

German Search Report for German Application No. 10 2006 018 768.7; English-Language Translation.

*Primary Examiner*—Gene Crawford
*Assistant Examiner*—William R Harp
(74) *Attorney, Agent, or Firm*—Venable LLP; Robert Kinberg; Leigh D. Thelen

(57) ABSTRACT

An apparatus for conveying sheet-type flat items to a sheet-collecting location includes at least one lower belt conveyor and one upper belt conveyor arranged above the lower belt conveyor. A first operating mechanism is arranged to move the upper belt conveyor relative to the lower belt conveyor between (1) a lower position in which the upper belt conveyor is in an operating position adjacent to the lower belt conveyor and comes in contact with the flat items positioned on the lower belt conveyor and (2) a raised upper position in which the upper belt conveyor has a segment positioned at such a distance to the lower belt conveyor as to be out of contact with the flat items positioned on the lower belt conveyor.

11 Claims, 2 Drawing Sheets

FOREIGN PATENT DOCUMENTS

| | | | |
|---|---|---|---|
| DE | 197 03 222 | A1 | 7/1997 |
| DE | 198 40 420 | A1 | 3/2000 |
| DE | 199 45 114 | A1 | 3/2001 |
| EP | 0 249 874 | A1 | 12/1987 |
| EP | 0 352 694 | A1 | 1/1990 |
| EP | 1 041 027 | B1 | 3/2000 |
| EP | 1 214 264 | B1 | 9/2000 |

* cited by examiner

APPARATUS FOR CONVEYING SHEET-TYPE FLAT ITEMS

CROSS-REFERENCE TO RELATED APPLICATION

This application claims the priority of German Patent Application No. 10 2006 018 768.7, filed on Apr. 20, 2006, the subject matter of which is incorporated herein by reference, together with each U.S. and foreign patent and patent application mentioned herein below.

BACKGROUND

The present invention relates to an apparatus for conveying sheet-type flat items that consist of a flexible material, in particular sheets of paper, to a sheet-collecting location. Such an apparatus may include at least one lower belt conveyor and one upper belt conveyor, which is arranged above the lower belt conveyor.

European patent document EP 0 249 874 A1, discloses a machine for stacking and bundling printed sheets. This known machine is provided with a lower belt conveyor and an upper belt conveyor. For the purpose of removing a jam, the lower belt conveyor can swivel downward and out of the operating position, with the help of a cylinder piston.

German patent document DE 29 20 667 A1 describes an apparatus for stacking print products. This known apparatus comprises, among other things, a transfer-out device which consists of an upper belt and a lower belt. The transfer-out device is positioned such that it can swivel on one side, wherein the swiveling movement is controlled by a spindle drive and serves to adjust a desired height for removing the stack to be formed.

German patent document DE 34 48 456 A1 discloses an apparatus for diverting a partial flow from an overlapping flow of print products and conveying it to a processing station. Among other things, this known apparatus comprises a conveyor that can be swiveled with the help of a pneumatic cylinder to move between two discharge levels.

A compression rolling machine is known from European patent document EP 352 694 A1 for the automatic rolling of documents. This known machine is not provided with a belt conveyor, but with two roller conveyors arranged in the shape of a V, of which the upper roller conveyor can be swiveled upward for the purpose of removing a jam.

An apparatus for collecting paper of varying length, in particular label strips, is disclosed in German patent document DE 197 03 222 A1. This known apparatus is provided with a lower belt conveyor, but not with an upper belt conveyor. Instead, a roller conveyor is arranged above the lower belt conveyor, which can be swiveled upward for the purpose of removing a jam.

In a similar manner, German patent document DE 198 40 420 A1 discloses an apparatus for conveying sheet-type goods, in particular banknotes. The known apparatus also comprises a lower belt conveyor and no upper belt conveyor. Instead it is also provided with an above-arranged upper roller conveyor, which can be swiveled upward for the purpose of removing a jam.

A device for forming an overlapping flow, which is arranged downstream of a cross cutter, is described respectively in German patent document DE 199 45 114 A1 and the corresponding European patent document EP 1 214 264 A1. This known apparatus comprises a transfer-out device, upper and lower acceleration belts, and a suction box with a downstream-arranged lower belt that functions as a deceleration belt. The distance between the upper belts and the conveying plane can be adjusted in order to adapt to the thickness of the overlapping flow to be formed. The upper and the lower belts can furthermore be adjusted in the conveying direction and counter to the conveying direction for a change in the format, wherein the transfer-out device is also embodied swiveling for the purpose of removing a jam.

SUMMARY

An embodiment according to the invention provides for an apparatus for conveying sheet-type flat items to a sheet-collecting location, comprising: at least one lower belt conveyor; at least one upper belt conveyor arranged above the lower belt conveyor; and a first operating mechanism arranged to move the upper belt conveyor relative to the lower belt conveyor between (1) a lower position in which the upper belt conveyor is in an operating position adjacent to the lower belt conveyor and comes in contact with the flat items positioned on the lower belt conveyor and (2) a raised upper position in which the upper belt conveyor has a segment positioned at such a distance to the lower belt conveyor as to be out of contact with the flat items positioned on the lower belt conveyor.

An advantage of the foregoing embodiment is that the user has full access to the sheet-collecting location for making an adjustment and for setting up the machine, as well as for removing any obstructions. The option of raising the upper belt conveyor is advantageous, in particular, for the adjustment operations and for removing paper jams, because it is possible to freely access the paper goods, for example, to easily remove and release jammed-in paper. Owing to the fact that the lower belt conveyor remains stationary in its operating position, it cannot be swiveled downward. On the other hand, the upper belt conveyor according to the embodiment can be raised from its operating position in an upward direction, so that any paper which may still be stuck inside the apparatus is prevented from dropping down and out of the apparatus. This not only facilitates the adjustment and maintenance operations, but also makes it easy to analyze and reconstruct the paper movement for making specific adjustments or for removing obstructions, since the paper remains inside the apparatus.

The first operating mechanism may comprise a first swiveling device for displacing the upper belt conveyor around a first swivel axis, wherein the first swivel axis can extend at an angle, preferably approximately at a right angle, to the conveying direction of the belt conveyor. For a particularly easy access to the sheet-collecting location, it is advantageous if the first swivel axis is positioned upstream of a downstream-positioned segment of the upper belt conveyor which is out of contact with the flat items positioned on the lower belt conveyor when the upper belt conveyor is raised to the upper position.

To prevent the upper belt conveyor from unintentionally dropping down when it is in its upper raised position, the first operating mechanism may advantageously be provided with a first locking device for the selectively locking in place the upper belt conveyor in the upper position. The first locking device may comprise a first recoil claw.

According to a further embodiment, there is provided an overlap device and a second operating mechanism for moving the overlap device, relative to the lower belt conveyor, between a lower position, in which the overlap device is in an operating position adjacent to the lower belt conveyor, and an upper position, in which the overlap device is at a distance to the lower belt conveyor to prevent any contact with the flat items positioned on the lower belt conveyor.

The flat items must of necessity be overlapped for the task of collecting and/or stacking them. If the flat items are not conveyed in an overlapping flow to the sheet-collecting location, the overlap device may thus be positioned to deflect the trailing edge of the flat item already conveyed to the sheet-collecting location downward from the conveying plane, so as not to hinder the following flat item when it enters the sheet-collecting location. By contrast, if the flat items arrive in the sheet-collecting location in the form of an overlapping flow, the function of the overlap device is not needed. The invention takes into consideration this circumstance by moving the overlap device with the aid of the second operating mechanism into an upper position, in which the overlap device is at a distance to the lower belt conveyor where it does not have an effect on the conveyed flow and thus the flat items positioned on the lower belt conveyor. As a result, two operating modes may be combined in one and the same apparatus.

An additional advantage is that the upper position of the overlap device may simultaneously function as the adjustment position that provides good access, for example for making the required adjustments and adaptations to the overlap device to permit an easy and comfortable format change.

The second operating mechanism may comprise a second swivel device for swiveling the overlap device around a second swivel axis. The second swivel axis may extend at an angle, preferably approximately at a right angle, relative to the conveying direction of the belt conveyor.

The overlap device may advantageously be arranged such that it may swivel in the same direction as the upper belt conveyor for moving between the lower position and the upper position, wherein it would be advantageous to arrange the first and second swivel axes adjacent to each other.

To prevent an unintended dropping down of the overlap device from the upper position, the second operating mechanism may include a second locking device for selectively locking in place the overlap device in the upper position. For this, the second locking device may comprise a second recoil claw.

Within the meaning of the present disclosure, the term "belt conveyor" refers to a single conveying belt having an optional width, as well as a group of jointly driven conveying belts having essentially the same length and the same or different widths, which are arranged substantially parallel to each other, wherein the conveying belt or the conveying belts are usually embodied as endlessly circulating conveying belts.

BRIEF DESCRIPTION OF THE DRAWINGS

These and other features and advantages of the invention will be further understood from the following detailed description with reference to the accompanying drawings.

DETAILED DESCRIPTION

The apparatus shown in the Figures represents a component of a paper processing machine that is not fully shown herein. In this machine, a paper web (among other things) is supplied with the aid of conveying belts to a cross cutter, which is also not shown herein, and is cut by the cross cutter into sheets of a desired length. The cut sheets that are trimmed to a specific format are subsequently conveyed through the apparatus shown in the Figures to a sheet-collecting location, also not shown, in which they are deposited one above the other in stacks. The apparatus shown in the Figures is used for a direct transfer to the sheet-collecting location and is therefore arranged essentially at the end of the processing line for the paper processing machine.

For the sake of completeness and to simplify the representation, the belt conveyors are represented in the Figures as a single conveying belt and described as such in the following description. Alternatively, however, a group of jointly driven conveying belts that are arranged parallel to each other can also be used. The conveying belts shown herein and described in the following are endless belts, which are driven by individual drives that are not shown herein. A belt conveyor therefore comprises not only the conveying belt or belts, but also the associated drive.

Referring to the Figures, there is shown an apparatus, which represents a collection and transfer device, that includes a stationary lower belt conveyor 2 and an upper belt conveyor 4. The surface of the upper belt section 2*a* of the lower belt conveyor 2 serves as the conveying path and/or the conveying plane, wherein the sheets of paper that are not shown individually herein are conveyed in the direction of arrow A, meaning from the left to the right in the Figures.

Figure 1:
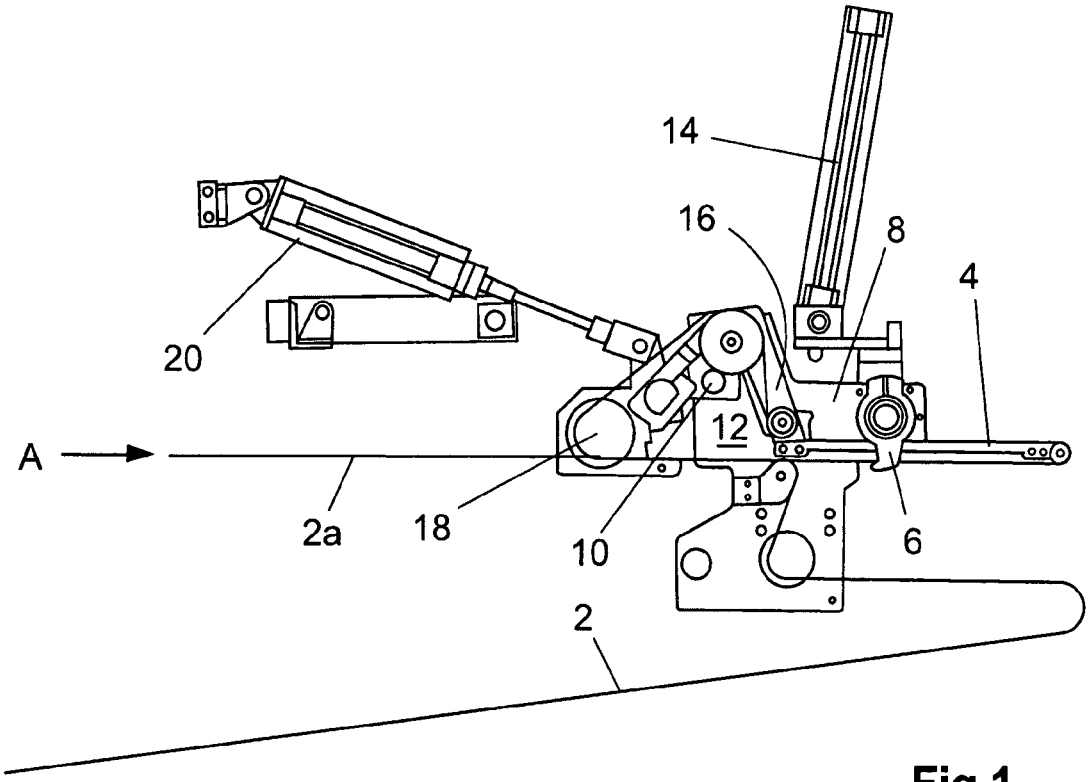
FIG. 1 is a schematic view from the side of an embodiment of the apparatus according to the invention, in a first operating state for collecting sheets that are not conveyed in an overlapping flow.
Figure 2:
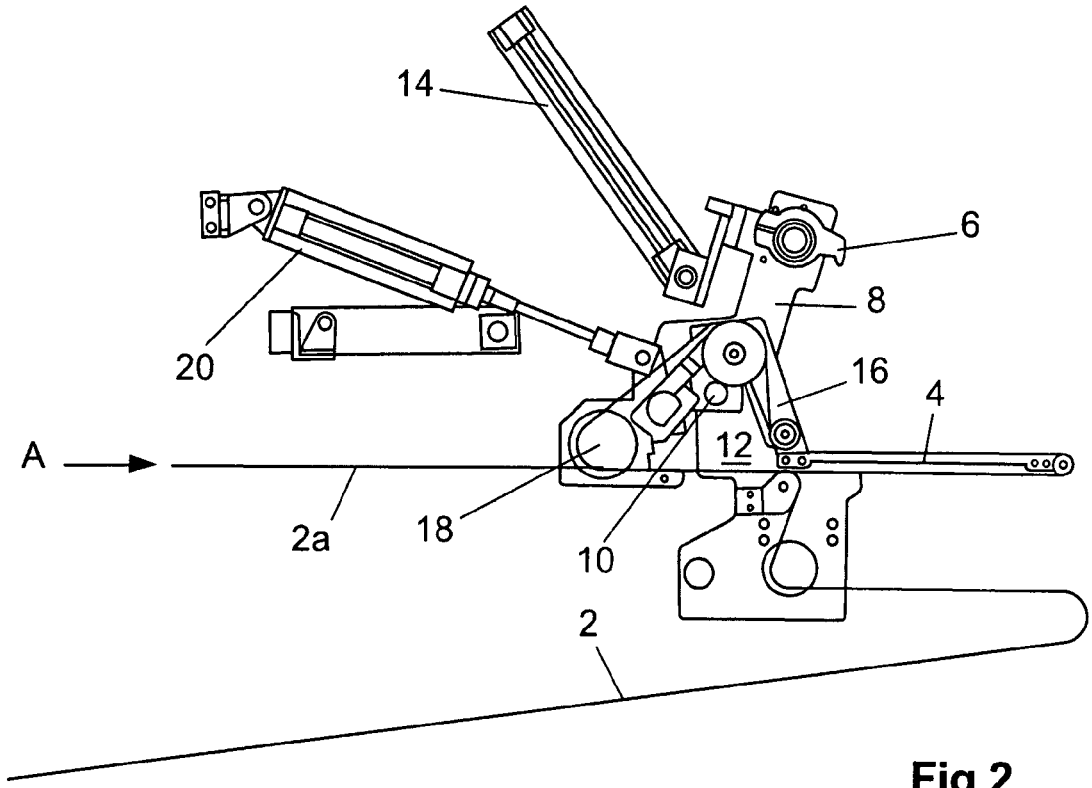
FIG. 2 is a schematic view from the side of the same embodiment as in FIG. 1, in a second operating state for collecting overlapped sheets.

In an operating position of the apparatus shown in FIGS. 1 and 2, the upper belt conveyor 4 is arranged directly above the lower belt conveyor 2, wherein the upstream-positioned segment of the lower belt section of the upper belt conveyor 4 overlaps the downstream-positioned end segment of the upper belt section 2*a* of the lower belt conveyor 2. In the embodiment shown herein, the downstream-positioned segment of the upper belt conveyor 4 is exposed and projects over a sheet-collecting location that is not shown in the Figures.

In a region of the upstream-positioned segment of the upper belt conveyor 4 and adjacent to the end of the upper belt section 2*a* of the lower belt conveyor, FIG. 1 shows a rotating overlap finger 6 in its operating position. If the sheets of paper are conveyed without being overlapped, that is individually and one after another, through the illustrated apparatus and to the sheet-collecting location (not shown), it is necessary for the trailing edge of the respective paper sheet to be pushed downward from the conveying plane at the instant when the sheet of paper is moving from the apparatus to the sheet-collecting location, so that the following paper sheet with its leading edge can run up onto the preceding paper sheet that is already moving into the sheet-collecting location. The trailing edge of a paper sheet is pushed downward with the overlap finger 6, which rotates with the timing of the paper sheets that are moving past. In FIG. 1, the overlap finger 6 is shown in a momentary position where it pushes down the trailing edge of a paper sheet, in a manner as described above.

The overlap finger 6 is positioned rotating on a swivel holder 8, which in turn is attached to a frame 12, such that it can swivel around a swivel axis 10. For the illustrated embodiment, the overlap finger 6 can thus be swiveled, from the lower operating state shown in FIG. 1 to an upper idle position shown in FIG. 2, around the swivel axis 10, approximately at a right angle to the conveying direction according to arrow A. Swivel axis 10 is approximately parallel to the upper belt section 2*a* of the lower belt conveyor 2. The function of the overlap finger 6 is not needed when conveying an overlapping paper flow through the illustrated apparatus to the sheet-collecting location (not shown), because the conveyed sheets of paper are already overlapped, which is a precondition for collecting the sheets in the non-depicted sheet-collecting location. For this operation, the overlap finger 6 is swiveled from its operating position shown in FIG. 1 to the raised, idle position according to FIG. 2. Thus, in cases where the sheets of paper are already conveyed in an overlapping flow, the overlap finger 6 is deactivated by swiveling it upward and removing it completely from the conveying flow.

An operating mechanism 14 is provided for the swiveling movement, which may comprise either an electric-motor drive or a pneumatic drive. A comparison of FIGS. 1 and 2 shows that the operating mechanism 14 for the illustrated embodiment also executes a swiveling movement. For this purpose a pneumatic piston-cylinder-arrangement is selected for the operating mechanism 14, wherein the cylinder is attached articulated to the swivel holder 8, and the piston rod (not visible in the Figures) is attached articulated to the frame 12. As a result of this design, the operating mechanism 14 also executes a swiveling movement during the activation, albeit a shorter one than the movement carried out by the swivel holder 8 with overlap finger 6. Of course, it is also conceivable to install the operating mechanism 14 stationary and to design the mechanism such that if a pneumatic cylinder-piston arrangement is used, the mechanism is attached articulated to the swivel holder 8.

Figure 3:
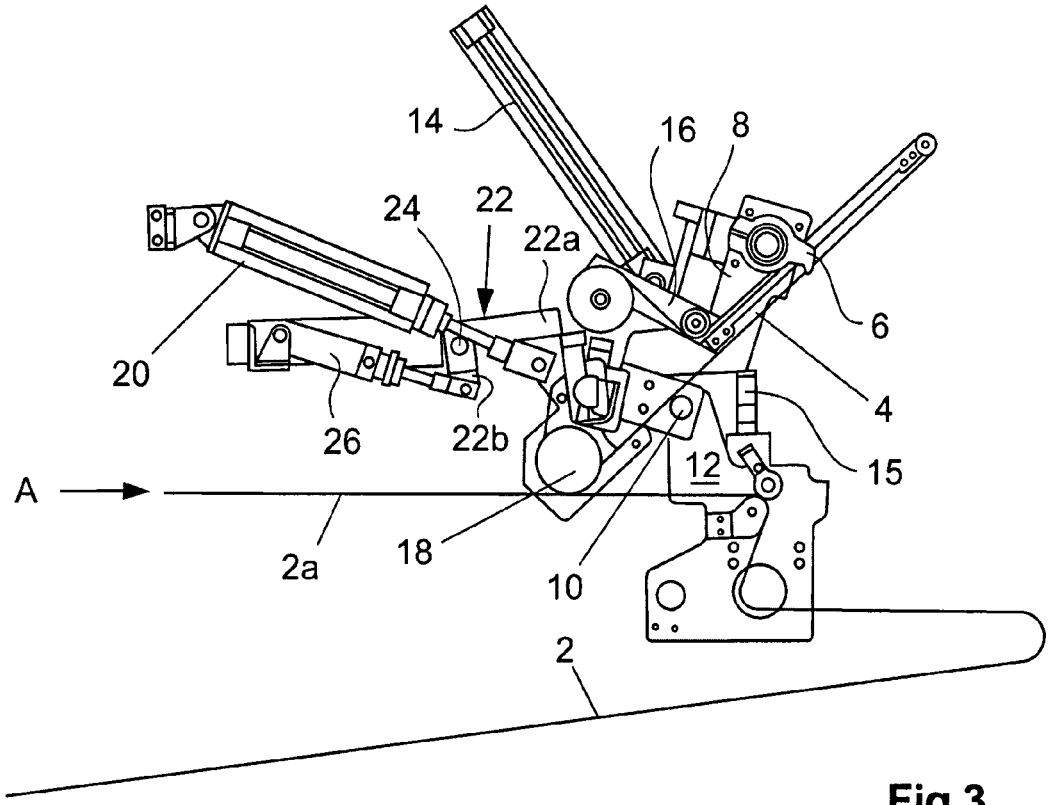
FIG. 3 is a schematic view from the side of the same embodiment as shown in FIG. 1, in an opened state while standing still.

A recoil safety device can be provided for safety reasons, which locks the swivel holder 8 that carries the overlap finger 6 into the position shown in FIG. 2. FIG. 3 shows an example of such a recoil safety device, which may comprise an end stop 15 positioned extendable and/or swiveling in its operating position. As shown, swivel holder 8 rests on end stop 15.

The upper, idle position shown in FIG. 2 can simultaneously function as an adjustment position because the overlap finger 6 can be moved to the required operating position during a format change. As shown in the Figures, the overlap finger 6 is attached to one end of the swivel holder 8, which is positioned downstream relative to the conveying direction according to arrow A. In the swiveled-up, idle position, the arrangement can therefore be accessed from the sheet-collecting location (not shown), as shown in FIG. 2.

A group of several parallel and coaxially arranged overlap fingers can also be provided in place of the single overlap finger 6, shown in the Figures. Furthermore, the overlap finger 6 drive that is not shown in the Figures may also be attached to the swivel holder 8, so that the complete unit, consisting of the overlap finger 6 and the associated drive, may be swiveled between the operating position shown in FIG. 1 and the upper, idle position shown in FIG. 2.

As previously mentioned, the upper belt conveyor 4 is necessary for the transport to the sheet-collecting location, which is not shown herein. Similarly to the overlap finger 6, the upper belt conveyor 4 can also be moved between a lower operating position as shown in FIGS. 1 and 2 and an upper, idle position as shown in FIGS. 3 and 4.

For this, the upper belt conveyor 4 is mounted on a swivel holder 16, which is attached with the aid of a swivel axis 18 to the frame 12, such that it can swivel. For the embodiment shown herein, the swivel axis 18 extends in the same way as the swivel axis 10, approximately at a right angle to the conveying direction shown with arrow A and parallel to the upper belt section 2*a* of the lower belt conveyor 2. The Figures furthermore show that the two swivel axes 10, 18 are arranged adjacent to each other, above the downstream-positioned end segment of the upper belt section 2*a* of the lower belt conveyor 2.

An operating mechanism 20 is provided for the upper belt conveyor 4, which can comprise an electric motor drive or a pneumatic drive.

Figure 4:
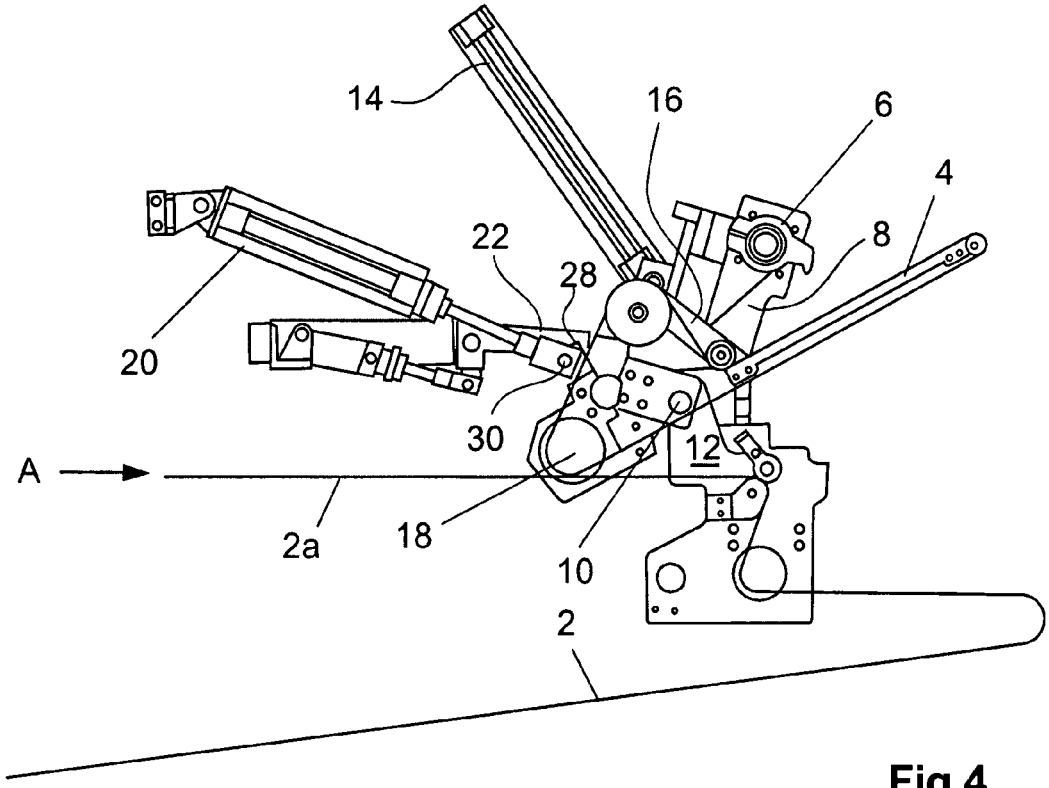
FIG. 4 is a schematic view from the side, showing the same situation as shown in FIG. 3, wherein the opened device is in a locked position.

To secure the upper belt conveyor 4 in the upper, idle position shown in FIG. 3 and to prevent an unintended dropping, for example, as a result of a pneumatic pressure loss in the operating mechanism 20, a recoil safety device may also be provided for locking in place the upper belt conveyor while it is in the raised position, as shown in FIG. 4. For the embodiment shown herein, this is achieved with an L-shaped recoil claw 22 that is positioned to swivel around a stationary fulcrum 24. Whereas the one, longer leg 22*a* of the L-shaped recoil claw 22 points in the direction of the swivel holder 16, the shorter leg 22*b* of the L-shaped recoil claw 22 is coupled to an operating mechanism 26. For the illustrated embodiment, this operating mechanism consists of a pneumatic piston-cylinder arrangement and is positioned stationary swiveling. With this operating mechanism 26, the recoil claw 22 can be swiveled correspondingly around the fulcrum 24. In FIG. 3, the recoil claw 22 is shown in the raised, idle position whereas in FIG. 4, it is shown in a downward swiveled, locked position. For the locked position according to FIG. 4, the recoil claw 22 engages with a recess 28, visible only in FIG. 4, in the long leg 22*a* in a pin 30 that is attached to the swivel holder 16 and simultaneously functions as a joint for coupling-on the operating mechanism 20, which is also shown in FIG. 4.

The above-described arrangement is configured such that the segment of the upper belt conveyor 4 that is positioned downstream, relative to the conveying direction shown with arrow A, is swiveled in an upward direction. In the raised, idle position of the upper belt conveyor 4, easy access is provided from the sheet-collecting location (not shown), as can be seen in FIGS. 3 and 4.

The circulating conveying belt of the upper belt conveyor 4 and its drive can be mounted on the swivel holder 16. In this manner the upper belt conveyor 4 together with its drive can be swiveled as a complete unit between the lower operating position shown in FIGS. 1 and 2 and the raised, idle position shown in FIGS. 3 and 4.

To be sure, for the illustrated embodiment, the upper belt conveyor 4 can be swiveled separately from the overlap finger 6. However, the overlap finger 6 may advantageously first be moved to its upper, idle position before the upper belt conveyor 4 is moved to its raised, idle position to provide complete access to the apparatus from the sheet-collecting location (not shown), in the region of the conveying plane.

It is furthermore also conceivable to provide a coupling mechanism, which optionally permits swiveling the upper belt conveyor 4 and simultaneously also the overlap finger 6 during a single operating step from the lower operating position to the upper, idle position.

The apparatus illustrated in the Figures has been described in connection with the processing of sheets and/or sheets of paper, but can in principle be used for the processing and/or the conveying of all types of flat items, preferably consisting of a flexible material.

It will be understood that the above description of the present invention is susceptible to various modifications, changes and adaptations, and the same are intended to be comprehended within the meaning and range of equivalents of the appended claims.

What is claimed is:

1. An apparatus for conveying sheet-type flat items to a sheet-collecting location, comprising:

at least one lower belt conveyor;

at least one upper belt conveyor arranged above the lower belt conveyor;

a first operating mechanism including a first swivel device arranged to swivel the upper belt conveyor around a first swivel axis relative to the lower belt conveyor between (1) a first lower position in which the upper belt conveyor is in an operating position adjacent to the lower belt conveyor and comes in contact with the flat items positioned on the lower belt conveyor and (2) a raised first upper position in which the upper belt conveyor has a segment positioned downstream of the upper belt conveyor at such a distance to the lower belt conveyor as to be out of contact with the flat items positioned on the lower belt conveyor;

at least one overlap device; and a second operating mechanism arranged to move the overlap device, relative to the lower belt conveyor, between a second lower position in which the overlap device is in an operating position to come in contact with the flat items positioned on the lower belt conveyor and a second upper position in which the overlap device is in a non-operating position such as to be at a distance to the lower belt conveyor that the overlap device cannot come in contact with the flat items positioned on the lower belt conveyor, wherein the overlap device can be swiveled in the same direction as the upper belt conveyor to move the overlap device between the second lower position and the second upper position.

2. The apparatus according to claim 1, wherein the first swivel axis extends at approximately a right angle relative to the conveying direction for the belt conveyors.

3. The apparatus according to claim 1, wherein the first swivel axis is located upstream of the downstream-positioned segment of the upper belt conveyor.

4. The apparatus according to claim 1, wherein the first operating mechanism includes a first locking device to selectively lock in place the upper belt conveyor in the raised upper position.

5. The apparatus according to claim 4, wherein the first locking device includes a recoil claw.

6. The apparatus according to claim 1, wherein the second operating mechanism includes a second swivel device to swivel the overlap device around a second swivel axis.

7. The apparatus according to claim 6, wherein the second swivel axis extends at an approximately right angle, relative to a conveying direction of the belt conveyors.

8. The apparatus according to claim 6, wherein the overlap device is a rotatable device having an axis of rotation and the second swivel axis is parallel to and spaced apart from the axis of rotation.

9. The apparatus according to claim 1, wherein the first and the second swivel axes are arranged adjacent to each other.

10. The apparatus according to claim 9, wherein the second operating mechanism includes a second locking device to selectively lock in place the overlap device in the upper position of the overlap device.

11. The apparatus according to claim 1, further comprising a coupling mechanism to couple the first swivel device and the second swivel device to allow simultaneous swiveling of the upper belt conveyor and the overlap device.

* * * * *